US006511707B1

(12) United States Patent
MacDonald et al.

(10) Patent No.: US 6,511,707 B1
(45) Date of Patent: Jan. 28, 2003

(54) APPARATUS AND METHOD FOR CONTROLLABLE APPLICATION OF A FLOWABLE MATERIAL TO A WORKPIECE

(75) Inventors: David Francis MacDonald, Suffield, CT (US); Michael Rollins McKinley, East Hartford, CT (US); Christopher Lee Musante, Coventry, CT (US); Salvatore John Shifrin, Windham, CT (US)

(73) Assignee: Loctite Corporation, Hartford, CT (US)

( * ) Notice: Subject to any disclaimer, the term of this patent is extended or adjusted under 35 U.S.C. 154(b) by 0 days.

(21) Appl. No.: 09/736,015

(22) PCT Filed: Sep. 23, 1999

(86) PCT No.: PCT/US99/22063

§ 371 (c)(1),
(2), (4) Date: Dec. 18, 2000

(87) PCT Pub. No.: WO00/16909

PCT Pub. Date: Mar. 30, 2000

Related U.S. Application Data

(60) Provisional application No. 60/101,491, filed on Sep. 23, 1998.

(51) Int. Cl.[7] ..... B05D 1/26; B05C 5/00; B08B 3/00

(52) U.S. Cl. ..... 427/256; 427/287; 118/315; 118/411; 118/412; 118/500

(58) Field of Search ..... 427/256, 287; 134/123; 156/578; 118/315, 410–412, 500, 323

(56) References Cited

U.S. PATENT DOCUMENTS

| | | | | |
|---|---|---|---|---|
| 4,272,301 A | | 6/1981 | Galbraith et al. | 134/8 |
| 4,747,541 A | * | 5/1988 | Morine et al. | |
| 4,950,505 A | | 8/1990 | Fogal | 427/327 |
| 5,694,324 A | | 12/1997 | Masters et al. | 364/468.25 |

* cited by examiner

*Primary Examiner*—Fred J. Parker
(74) *Attorney, Agent, or Firm*—Hoffmann & Baron, LLP

(57) ABSTRACT

A controllable device for applying a flowable material such as anti-seize composition to a workpiece utilizes a plurality of elongated nozzles insertably accommodated through a fixture plate to deposit such material onto the workpiece in a predetermined pattern. The fixture plate is provided with a corresponding number of apertures which accommodate different sizes and numbers of nozzles so that material may be applied to a large variety of workpieces without significant maintenance and modification to the device. The fixture plate is essential to define a predetermined clearance between an outlet through which the flowable material escapes from a nozzle and a surface onto which such material is applied and further cleans the nozzles in between application cycles to prevent overrun on to a workpiece surface. A corresponding method is provided which transfers flowable material from a storage reservoir to a plenum in flowable communication therewith which temporarily retains the material until an application cycle begins.

14 Claims, 7 Drawing Sheets

APPARATUS AND METHOD FOR CONTROLLABLE APPLICATION OF A FLOWABLE MATERIAL TO A WORKPIECE

This patent claims priority to U.S. Provisional Application No. 60/101,491, filed on Sep. 23, 1998, entitled "Apparatus and Method for Controllable Application of a Flowable Material to a Workpiece".

FIELD OF THE INVENTION

The present invention relates generally to an apparatus and method for even and controllable application of a flowable material to workpieces on assembly lines, such as automotive wheel hubs. More particularly, the present invention relates to a dispenser head assembly which employs a fixture plate for accurate and even application of a flowable material to a workpiece adjacent thereto.

BACKGROUND OF THE INVENTION

It is known in several industries, such as the automotive industry, to use sealants, adhesives, corrosion resistors and other flowable materials to accomplish various mechanical functions. Adhesives, for example, are often used on threads to prevent uncoupling between adjacent threaded components such as wheel studs and lug nuts. Corrosion resistant materials are likewise applied between wheel hubs and disc rotors to prevent hub/rotor misalignment and subsequent braking degradation. Use of such materials is desirable due to the low cost of the material in relation to the high cost of damage to vehicle components in the form of repair costs and legal liability.

As these industries demand and use more flowable materials during manufacture and assembly of parts, various methods have been developed to include application of the desired material to the object part as part of the assembly process, yet simultaneously retain the speed of production of the final product and minimize the cost thereof. Accordingly, equipment is constantly custom designed to not only address the general problem of how to consistently apply the flowable material, but also the specific problem of how to adapt the application method to a particular manufacturer's specifications.

In the past, such equipment has been designed to apply flowable products in an independent process rather than in an assembly-line type function. Heretofore, such application processes required modification in accordance with product specifications, which can vary from manufacturer to manufacturer and even within a manufacturer's own inventory. In order to change the process, the corresponding machinery which executed the process would likewise be modified from application cycle to application cycle. Subsequently, "down time" due to maintenance and modification of such machinery is prevalent, resulting in minimal production efficiency and maximum manufacturing costs.

Since the assembly line is pervasive in a multitude of industries and accordingly inherent to the proper and efficient production of a final product, it is desirable to provide a system which integrates the application method into an already existing manufacturing infrastructure. It is further desirable to design and construct appropriate corresponding equipment for accomplishing this task, wherein the machinery is easily customized to meet particular product specifications with minimal associated costs and complications.

The present invention provides an apparatus and method of applying a flowable material to a workpiece which can be integrated into an assembly line superstructure and which requires minimum maintenance and modification between application cycles. The apparatus is provided with easily machineable, replaceable and interchangeable parts which provide application capability to a multitude of workpieces without requiring modification of the parts from workpiece to workpiece, such that most workpieces can be processed using this technology.

SUMMARY OF THE INVENTION

One advantage of the present invention is the provision of a device which can be controlled to apply flowable material to a workpiece in a desired pattern. Such a device is desirable because it enables application to a variety of products in a precise, well-defined and repeatable manner.

Another advantage of the present invention is the use of a plurality of removably attached machined tubes or nozzles which deliver flowable material to a workpiece. Such tubes are desirable so that they may be easily replaced by tubes or nozzles of similar or different parameters or easily interchanged with one another so as to reduce maintenance time between application cycles.

It is yet another advantage of the present invention to provide a fixture means, such as a plate, which incorporates a plurality of holes which telescopically intercept the tubes or nozzles therethrough. Such fixture means is essential to define a predetermined clearance between an outlet through which flowable material escapes a tube or nozzle and a surface onto which such material is to be applied. Failure to define this clearance will result in uneven application of the material and subsequent mechanical malfunction. Such fixture means is further desirable to clean such tubes or nozzles between each application cycle to prevent overrun onto a workpiece surface. Removal of excess material is effected with each linear actuation of the tubes through the apertures, providing a clean tube outlet prior to each material dispensation.

It is still another advantage of the present invention to provide an associated method of controllably applying flowable material using the disclosed apparatus. During such a method, flowable material which is stored in a storage reservoir is pumped by a first pump to a second pump in fluid communication therewith. The second pump pressurizes and transfers the material to a plenum where the material is temporarily retained. The plenum is linearly moved toward a surface of the fixture means so that the tubes or nozzles affixed thereon are telescopically intercepted by corresponding apertures in the fixture means to a height where a predetermined clearance between the tube outlets and the surface of the workpiece is defined. During the linear actuation, material which has overrun from the tubes is wiped away due to the close spacing of the apertures, permitting run-off of the excess material into a separate container. Material flows from the tubes and is applied to the workpiece in a predetermined pattern which corresponds to the arrangement of the tubes. The workpiece is removed for assembly further down the assembly line, and the plenum is linearly actuated away from the fixture means to complete the application cycle.

DETAILED DESCRIPTION OF THE PREFERRED EMBODIMENTS

In the present invention, a dispense head assembly dispenses a controlled plurality of "dots" or "beads" of flowable material, such as anti-seize material, onto a workpiece, such as a hub face. Within this assembly, a positive displacement pump injects a controlled and repeatable amount of the material into a series of precision located and machined tubes, nozzles or the like (collectively referred to as "tubes") that vary in flow area. The tubes are fed flowable material from a common plenum for distribution of "dots" of material, the position and location of which are controlled by the tubes. A linear motion moves the tubes through a fixture plate which is adjacent the plenum during the dispense process. The tubes project up through the fixture plate to accurately locate the tubes in relation to the hub face, ensuring a predetermined, repeatable gap between the tubes and the hub. By creating sufficient flow resistance and fluid back pressure, this gap establishes a uniform plenum pressure to ensure accurate and controllable dispensation of fluid to all tubes. The fixture also acts as a containment barrier to keep the work area clean of material which overflows from the tubes into a catch basin positioned near the dispense head assembly.

Figure 1:
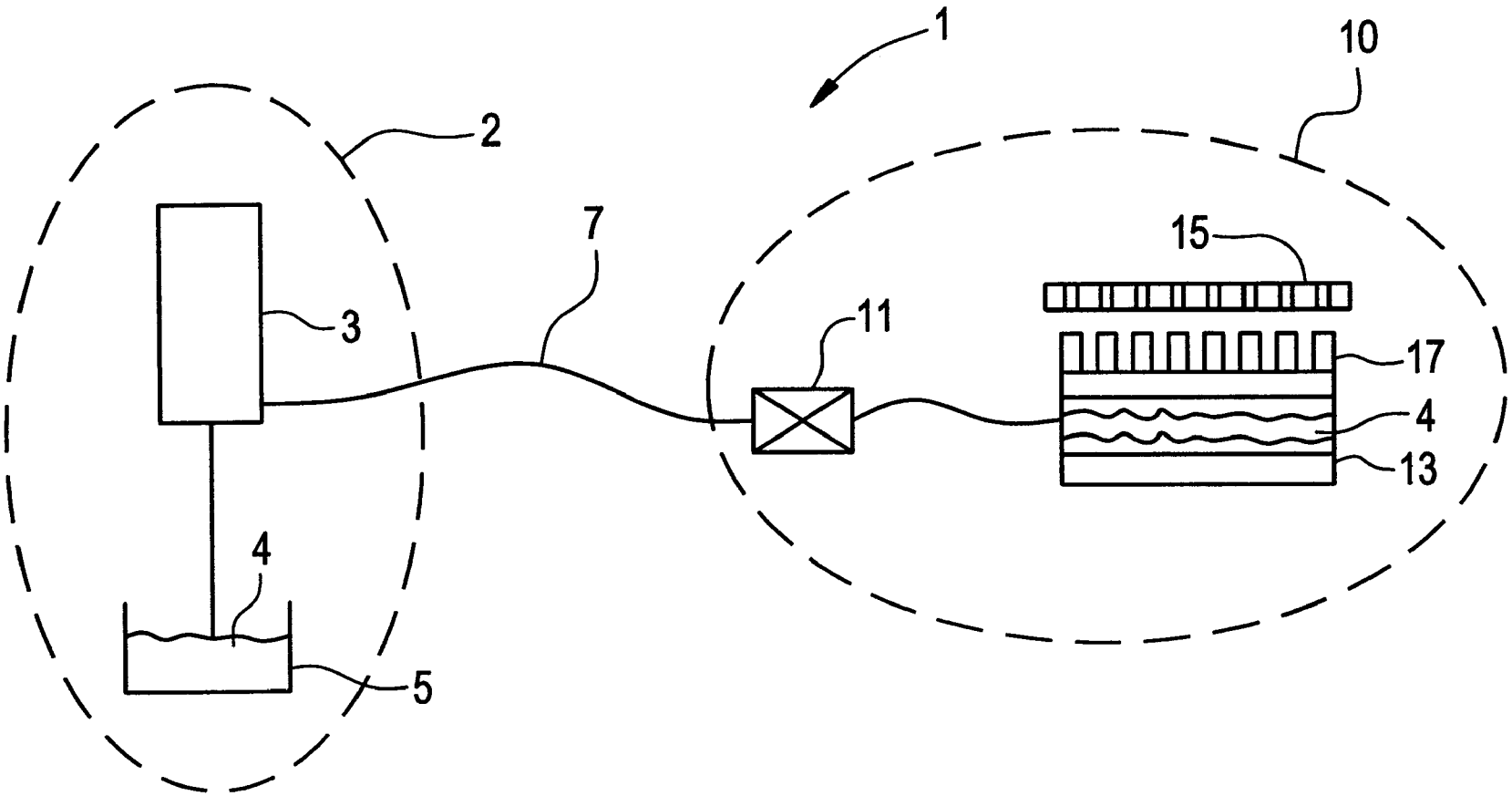
FIG. 1 shows a schematic representation of a dispensing system utilizing the application apparatus of the present invention.

Now referring to the drawings, in which like elements are identically numbered, and particularly referring to FIG. 1, a dispensing system 1 for applying a flowable material to a workpiece is shown having a pail pump assembly 2 and a dispense head assembly 10. Pail pump assembly 2 includes a pail pump 3 which is a conventional pump known and used in the art. Pump 3 pressurizes and transfers flowable material 4 from a pail 5 containing flowable material 4 therein to line 7 which interconnects pail pump assembly 2 and dispense head assembly 10. Such flowable material may be any material applied to a workpiece to perform its inherent purpose including anti-corrosion agents, lubricating agents and the like. Other flowable materials having other purposes and consistent with the operation of the present invention may also be utilized.

Material 4 is conveyed under pressure through route 7, shown here as a fluid line, to dispense head assembly 10 from which it is subsequently applied to a work piece, shown herein as a wheel hub. Although a wheel hub is shown herein, it is understood that any workpiece conducive to the operation of the present invention may be used. Dispense head assembly 10 includes a positive displacement pump 11, a plenum 13 for storing flowable material prior to its application to a wheel hub and a fixture plate 15 which facilitates delivery of material 4 to an adjacent wheel hub. Plenum 13 is provided with an array of custom-sized elongate flowable material conduits 17 assembled thereon. Conduits 17 convey flowable material in a predefined manner from the common plenum to a hub placed adjacent fixture plate 15.

Each conduit 17, which may be a tube, nozzle or the like, is configured and machined to correspond to the parameters of a workpiece which will receive the flowable material thereon. The conduits are given a predetermined arrangement which is sought to be applied to a workpiece. Conduits 17 are removably attached to an upper surface of common plenum 13 so as to facilitate easy modification of the dispenser head assembly. The conduits can be interchangeable with one another or replaceable by conduits of equal dimension or conduits of varying dimensions, depending on the size of the dot to be applied and the pattern needed to achieve adequate coverage over an area of a workpiece to be processed. In this manner, the number of conduits 17 and the dimensions thereof may be easily altered to conform to the specifications of a particular hub, for example, thereby enabling use of the application apparatus with most wheel hub types, regardless of source.

Figure 2:
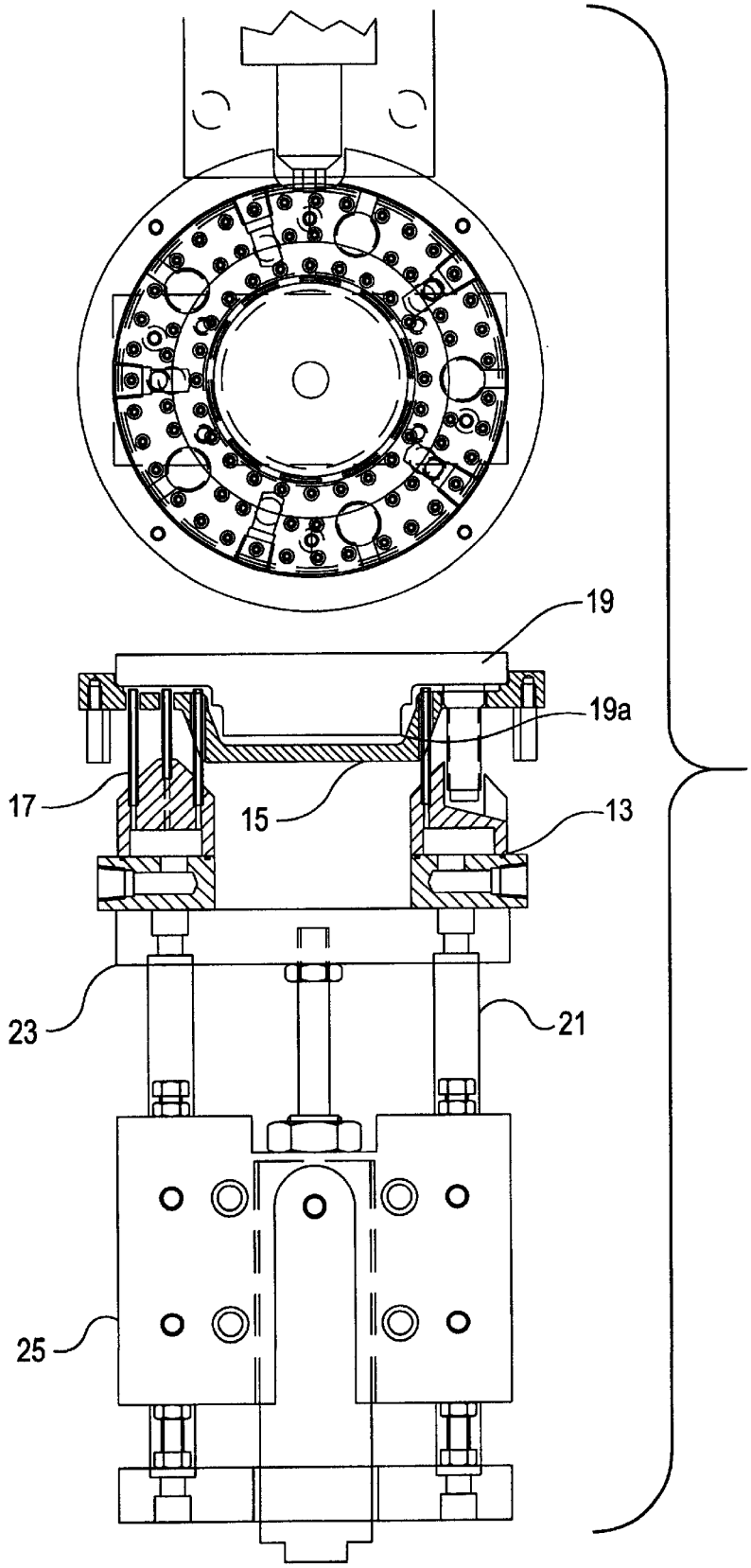
FIG. 2 shows a side view of a support structure supporting an application apparatus of the present invention.

Plenum 13 and fixture plate 15 of dispenser head assembly 10 may be configured to support a hub 19 as shown in FIG. 2. Plenum 13 is assembled upon a support structure 21 which includes a frame 23 and a slide 25 which permits linear motion of the plenum in relation to fixture plate 15. Frame 23 can be mounted to a fixed foundation such as a table or floor plate to minimize the vibrations experienced in a frame attached thereto. Although support structure 21 is shown as a generally conventional structural assembly, it is understood that other support configurations conducive to proper operation of the present invention may be implemented.

Figure 3A:
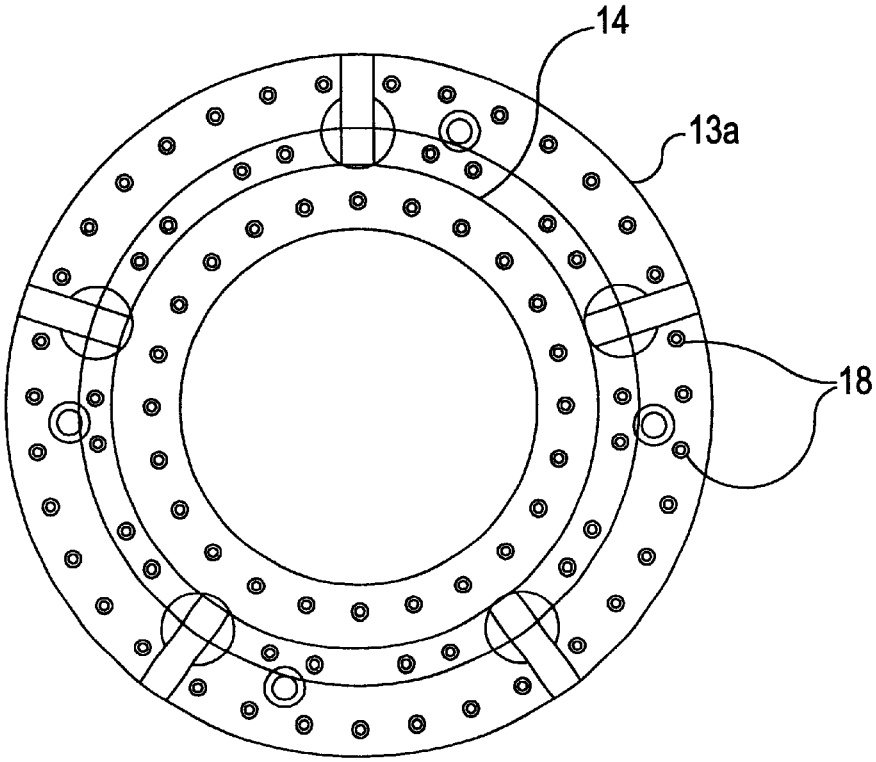
FIGS. 3A and 3B show a top view and a cross-section, respectively, of a dispersion plate of a plenum used in an application apparatus of the present invention.

Now referring to FIGS. 3A, 3B, 4A and 4B, plenum 13 can be seen to include a dispersion plate 13*a* which serves as a top surface of plenum 13 and a manifold plate 13*b* which serves as a bottom surface of plenum 13. Referring particularly to FIG. 3A, dispersion plate 13*a* is a substantially circular plate having a plurality of bores 14 which can accept a corresponding number of wheel studs 30 (shown in FIGS. 6 and 7) from a hub 19 therethrough. Dispersion plate 13*a* is additionally provided with a plurality of closely spaced orifices 18 through which a plurality of conduits 17 may be supported so as to draw a flowable material from within the plenum through the conduits for application to a hub face 19*a*.

Figure 3B:
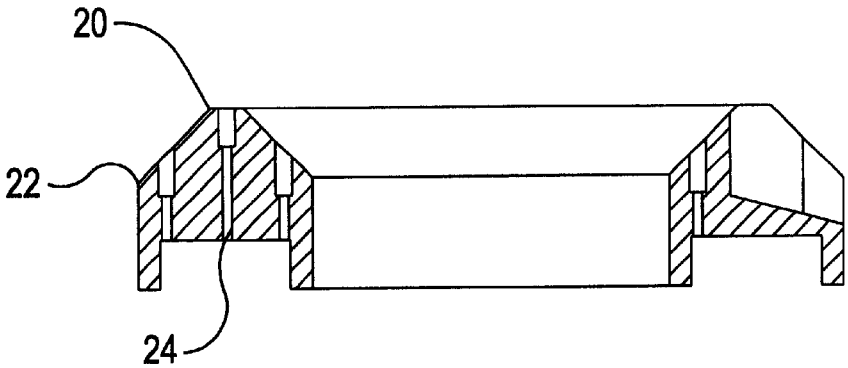

Further referring to FIG. 3B, a cross section of dispersion plate 13*a* is shown. Dispersion plate 13*a* is provided with a circumferential protrusion 20 having a sloped surface 22 defined thereon and through which a narrow passageway 24 is formed. Passageway 24 is sized and shaped so as to insertably accommodate a conduit 17 therethrough. Sloped surface 22 allows any flowable material which a escapes from an outlet of conduit 17 to run off dispersion plate 13*a* due to gravity. The inclusion of a sloped surface eliminates the probability that overflowing material will be applied to a work piece during a dispense cycle, thereby reducing the likelihood of misapplication and subsequent mechanical malfunctions.

In dispersion plate 13*a*, orifices 18 are sized, spaced and numbered to permit alteration of the number and arrangement of conduits 17 as they correspond to the specifications of the particular workpiece being worked upon. It is desirable to provide such orifices in a manner which will allow conduits 17 to be configured and subsequently modified so as to accommodating any changes in workpiece specifications which may occur between application cycles. In this manner, it is not necessary to disassemble the application apparatus every time a new type of wheel hub is selected to receive application of a flowable material. It is only necessary to change the location, size and or number of the conduits to correspond to the proper application pattern.

Figure 4A:
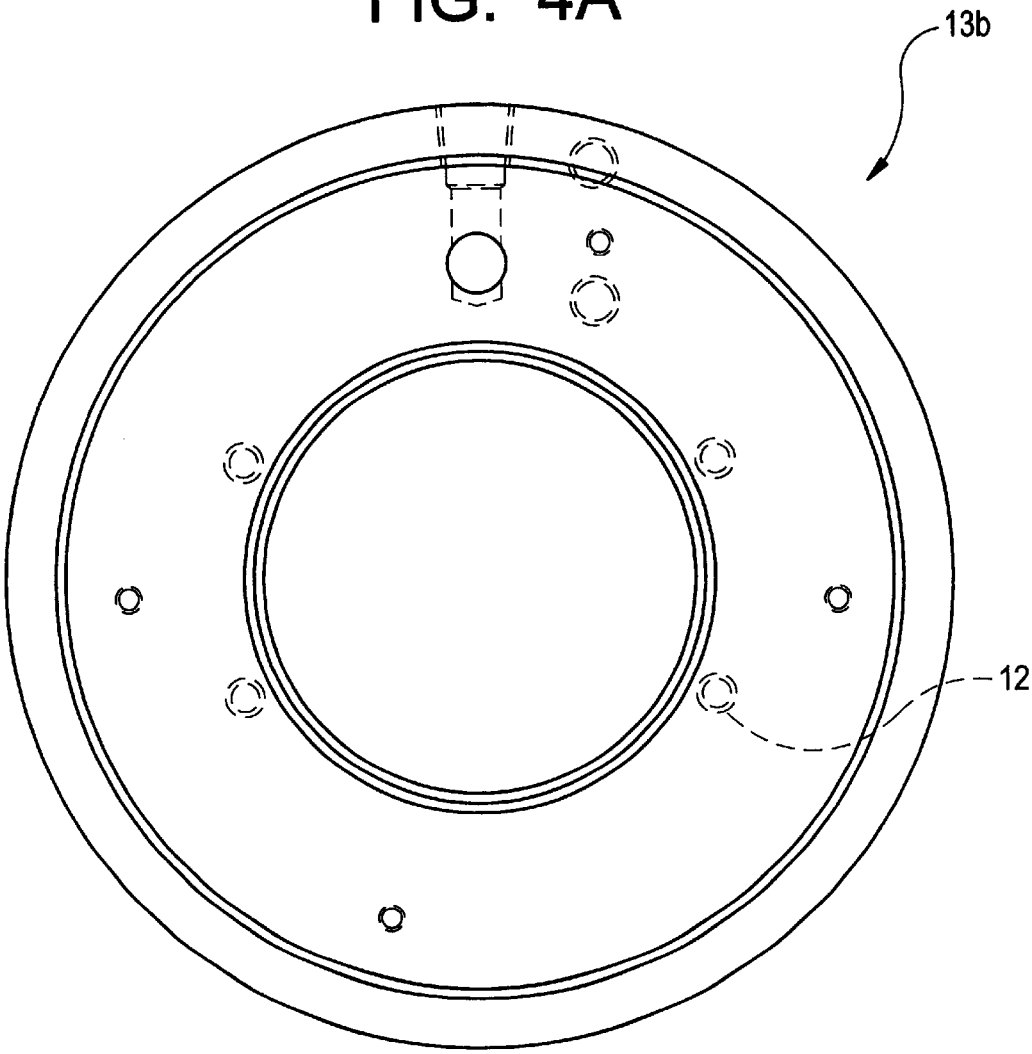
FIGS. 4A and 4B show a top view and a cross section, respectively, of a manifold plate of a plenum used in an application apparatus of the present invention.
Figure 4B:
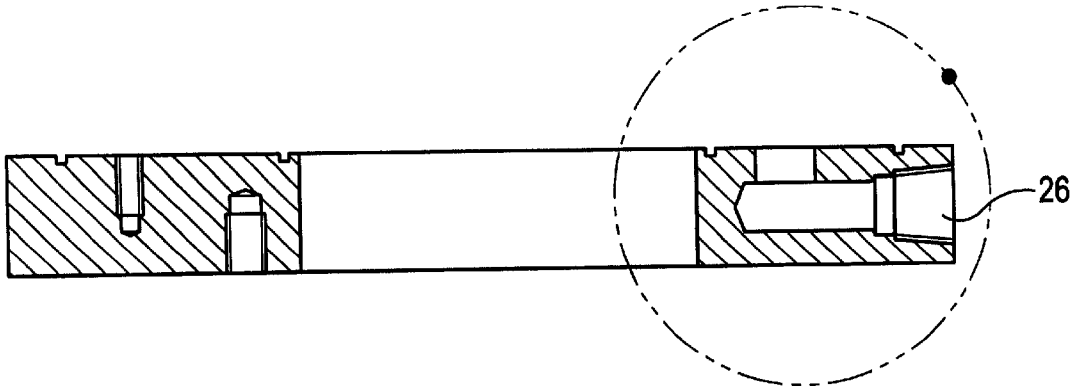

Referring particularly to FIGS. 4A and 4B, manifold plate 13*b* is a similarly substantially circular plate having a plurality of through bores. Through bores 12 provide adequate spacing and accommodation for affixing plenum 13 to a support structure 21, such as is done by a threaded fastening element, rivet or the like (not shown). However, fastening of plenum 13 to an accompanying support structure can be effected by any means conducive to the operation of the present invention.

Manifold plate 13*b* is also provided with at least one inlet port 26 through which flowable material 4 enters prior to application to a wheel hub. Port 26 is sized and configured to accommodate pressurized fluid material 4 as it is pumped from pump 11 into plenum 13. Plenum 13 acts as a temporary reservoir just between dispense cycles wherein flowable material enters, is stored for a short duration and is almost immediately dispensed through conduits 17 to a wheel hub. Thus, inlet port 26 must allow conduits 17 to draw material 4 from plenum 13 under a pressure suitable for a predefined application pattern to be duplicated from workpiece to workpiece.

Figure 5A:
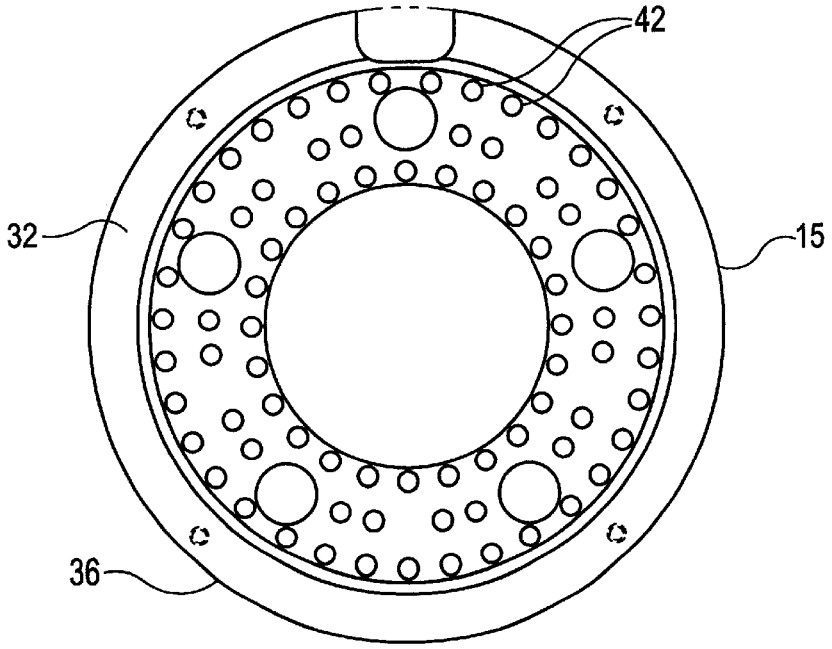
FIGS. 5A and 5B show a top view and a cross section, respectively, of a fixture plate used in an application apparatus of the present invention.
Figure 5B:
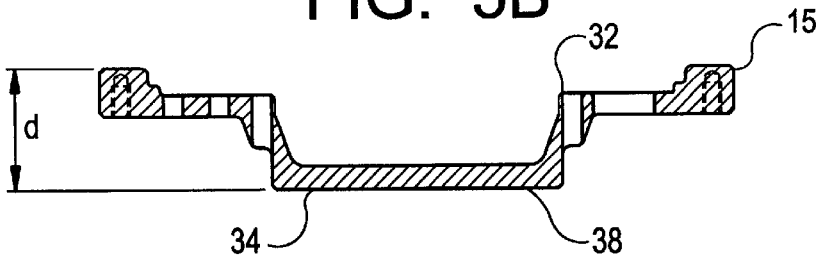
Figure 5C:
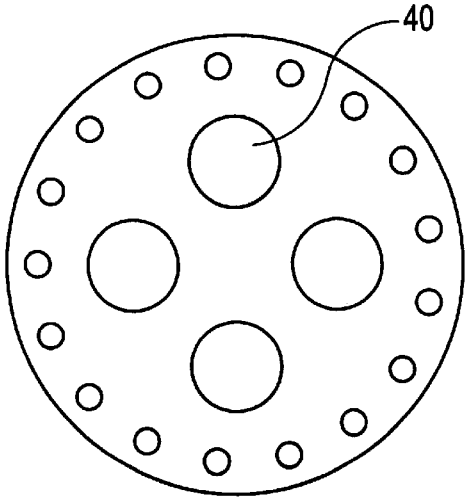
FIG. 5C shows a schematic of a top view of a fixture plate used in the present invention.

Dispense head assembly 10 further includes a fixture plate 15, shown in FIGS. 5A, 5B and 5C. Fixture plate 15 is a substantially circular plate which generally conforms to the geometry of a hub 19 placed adjacent thereto. Fixture plate 15 includes a top surface 32, a bottom surface 34 and a circumferential wall 36 extending therebetween. A recessed portion 38 is offset from a plane in which top surface 32 is defined by a distance which accommodates placement of similarly shaped wheel hub 19 therein.

Figure 6:
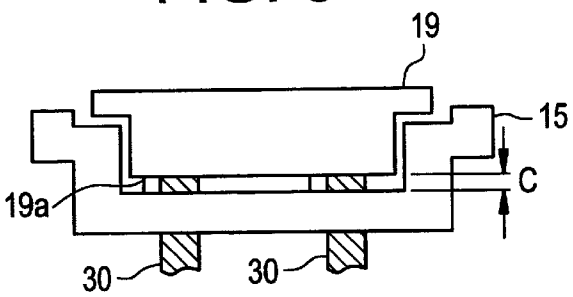
FIG. 6 shows a schematic view of a fixture plate and wheel hub assembly subject to an application process using the application apparatus of the present invention.

Referring particularly to FIGS. 5C and 6, a plurality of through bores 40 are defined through fixture plate 15 which accommodate wheel studs 30 of hub 19 during a dispense cycle. The fixture plate fixes the dispersion plate 13*a* of the plenum accurately in relation to the hub so as to provide acceptance for lug nuts. Fixture plate 15 is further defined as having a plurality of closely spaced apertures 42 which corresponds to an array of material conduits 17 having common plenum 13. As the number of conduits 17 may be altered to correspond to the geometry and specifications of a particular wheel hub, so can the number and size of apertures 42 be altered accordingly. It is desirable to permit such changes in the fixture plate so that only the fixture plate 15 needs to be changed in accordance with a change in wheel hub geometry. The entire apparatus does not need to be disassembled or maintained separately, thereby accommodating most of the wheel hub types used in the industry and simultaneously reducing the time and cost associated with an application procedure. It is understood that apertures 42 are registrable with conduits 17 to ensure proper alignment thereof.

Figure 7:
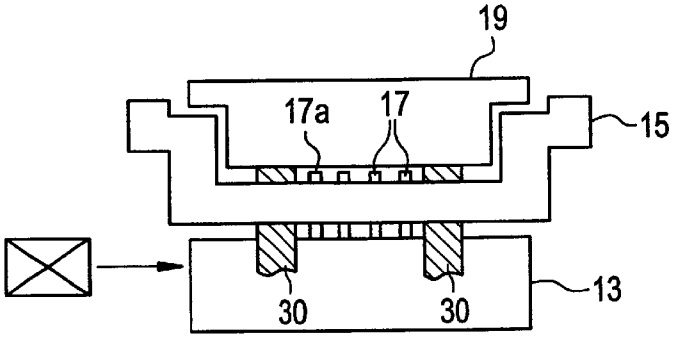
FIG. 7 shows the fixture plate and wheel hub of FIG. 6 in combination with a plenum having a plurality of flowable material conduits passing through said fixture plate.
Figure 8:
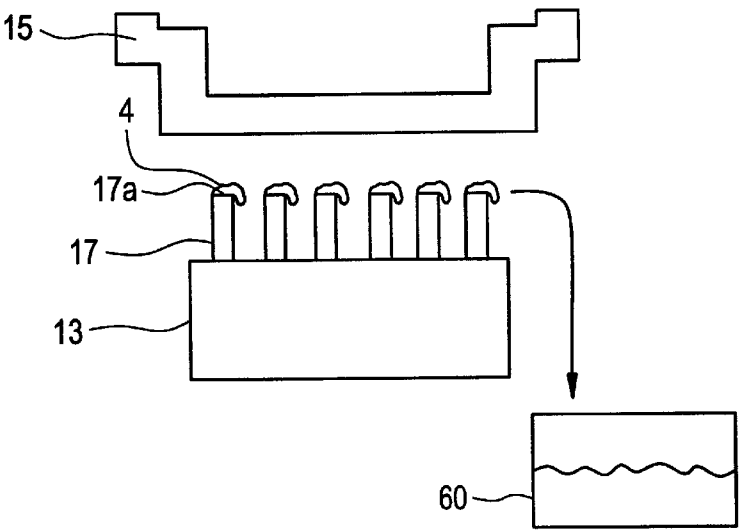
FIG. 8 shows the fixture plate of FIGS. 6 and 7 removed from said plenum wherein flowable material which overflows from said plenum is caught in an adjacent catch basin.

Having described the components of the dispense head assembly 10 of the present invention, the details of the preferred embodiment of the invention as well as its operation, may be described with respect to FIGS. 6–8.

To begin a dispense cycle, a pail pump 3 (shown in FIG. 1) pumps a flowable material 4 stored in a pail 5 through line 7 to positive displacement pump 11 of dispense head assembly 10. Positive displacement pump 11 pumps material 4 into plenum 13, connected thereto. Material 4 enters plenum 13 through an inlet port 26 defined in manifold plate 13*b*. Material 4 enters conduits 17, which act as needles that apply the material to an adjacent wheel hub in dots or beads according to the application pattern defined by a predetermined conduit array determined by the specification of the workpiece being processed.

Now referring to FIG. 6, a wheel hub 19 having studs 30 is located adjacent a fixture plate 15 such that hub face 19*a* is adjacent top surface 32. Hub 19 is positioned accurately above fixture plate so as to define a predetermined clearance c. Predetermined clearance c is distance between a bottom surface of a workpiece (i.e. hub face 19*a*) and top surface 32 of fixture plate 15. Proper definition of this clearance distance is essential to even and predictable application of the flowable material to hub face 19*a* in the desired application pattern. Without this clearance, the material will be improperly applied to the hub, resulting in an imbalance of the hub with respect to the fixture plate, improper location of flowable material thereon and subsequent functional flaws in the wheel hub assembly. After positioning is complete, wheel hub 19 is affixed to fixture plate 15 so as to maintain such predetermined clearance and prevent dislocation of wheel hub 19 in relation to fixture plate 15.

After wheel hub 19 has been properly positioned, plenum 13 is linearly moved so that conduits 17 are inserted through and retained in apertures 42 (See FIG. 5A) in fixture plate 15, as shown in FIG. 7. Conduits 17 enter through bottom surface 34 and extend through top surface 32 of fixture plate 15. Conduits 17 are fabricated and arranged so as to correspond to the configuration of the hub 19 and controllably apply flowable material 4 to hub face 19*a*. The conduits 17 are provided with an outlet 17*a* from which flowable material is dispensed. Outlet 17*a* is located a predetermined distance from hub face 19*a* which is less than the predetermined clearance c, so that material flowing therefrom is accurately dispensed thereon. This predetermined distance is defined as the distance between hub face 19*a* and outlet 17*a* which results in dispersion of flowable material in a bead like formation in a pattern corresponding to the conduit array. Linear movement of the conduits in relation to the fixture plate can be effected manually or automatically by any suitable means, such as a machine-operated slide.

Figure 9A:
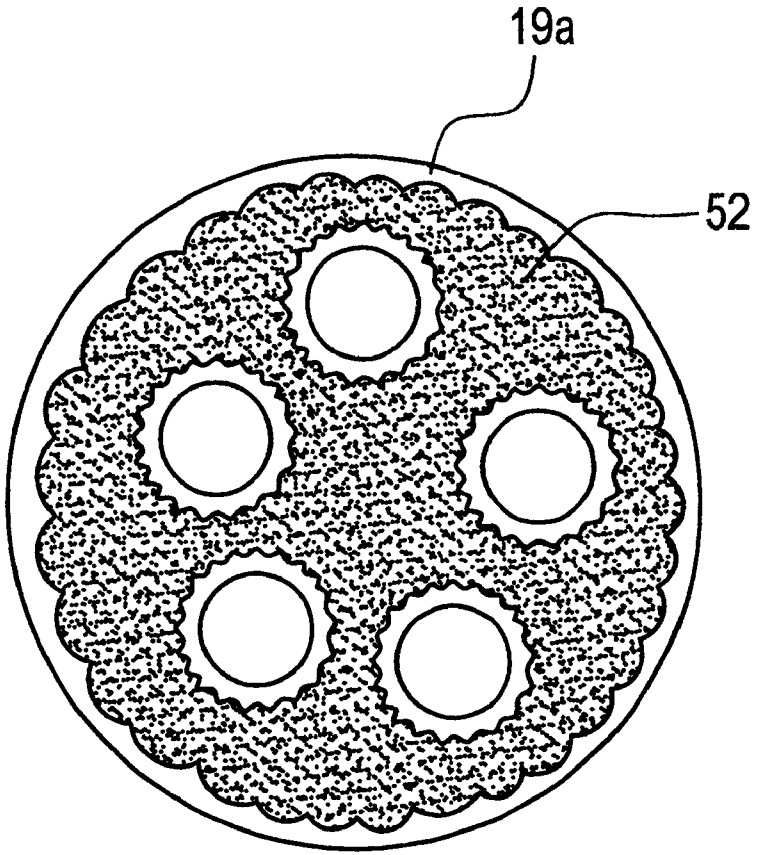
FIG. 9A shows the wheel hub of FIG. 9 wherein said beads of material become a thin fluid film after torquing.
Figure 9:
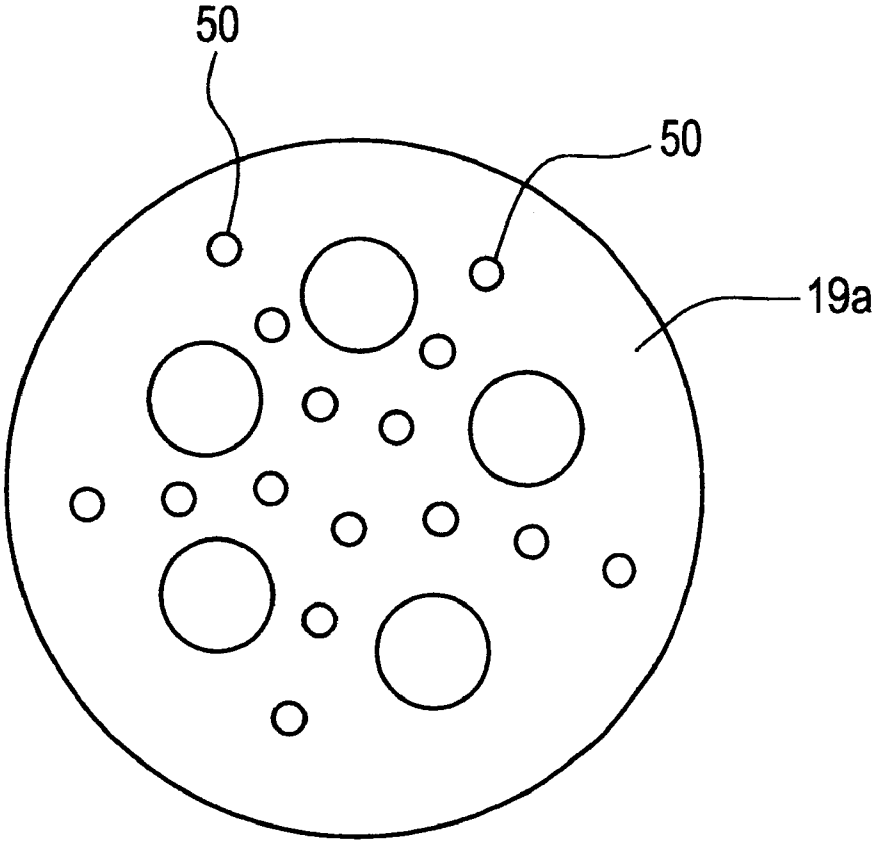
FIG. 9 shows a wheel hub having a plurality of bores with a plurality of beads of flowable material applied on a face thereof.

Conduits 17 inject material 4 from plenum 13 onto hub face 19*a*. By setting the conduits at the precise height to get a predetermined clearance distance, even application of the material onto the hub face is achieved in the desired pattern. The material is pumped and placed on the hub face in beads or dots 50, as shown in FIG. 9. After application of the dots, a disc brake rotor and a wheel may be assembled with the wheel hub. Lug nuts are coupled with the wheel studs 30 of hub 19 and accordingly torqued. Due to the torquing, the dots 50 of material 4 are "compressed" into a thin fluid film 52 which covers the surface area of hub face 19*a*. Spacing of the dots 50 is precisely determined prior to application so that this "spreading out" of the dots will create film 52 without overrun.

After a dispense cycle is completed and the application apparatus is in an "off dispense" mode, flowable material 4 remains under pressure in the plenum and contains air therein. Therefore, the material tends to "drool" out of conduits 17, as shown in FIG. 8. The close spacing of apertures 42 in fixture plate 15 enable the fixture plate to clean the material conduits between dispense cycles to prevent overrun of material onto a hub face 19*a*. As plenum 13 is raised toward fixture plate 15 during a dispense cycle, fixture plate 15 cleans the outlet 17*a* of each conduit 17 so that there is no overrun of material. The conduits, then, are cleaned during each dispense cycle. Overflowing material which escapes from plenum 13 runs off sloped surface 22 and is retrieved in a catch basin 60 adjacent thereto.

Thus, the disclosed application apparatus and associated technique allows for a precise, repeatable and controlled method of placing metered material onto the hub at discrete locations. Application machines can be custom designed to meet the requirements of each hub configuration so that most hubs can be processed using this technology. Thus, it would only be necessary to change the set-up of the detachable components such as the fixture plate and the material conduits without effecting a major reconfiguration of the system as a whole, thereby lowering assembly and maintenance costs and reducing lag time between dispense cycles.

Various changes to the foregoing described and shown structures would now be evident to those skilled in the art. Accordingly, the particularly disclosed scope of the invention is set forth in the following claims.

What is claimed is:

1. An apparatus for controllably applying a flowable material to a workpiece comprising:

one or more elongated conduits in registry with a plenum unit for transitory retention of said flowable material therein, each of said conduit outlet;

wherein said plenum unit comprises a dispense member having a plurality of orifices defined therethrough to accomodate said one or more elogated conduits in a predetermined arrangement and manifold member having at least one injection port defined therein for delivering said flowable material through said plenum unit;

and a fixture means having a top surface, a bottom surface and a peripheral wall extending therebetween, said fixture means having a surface to affix said workpiece thereto at a predetermined spacing relative to said to surface, said fixture means having plurality of apertures extending through said top surface and said bottom surface, said one or more elongated conduits being received in said apertures with said conduit outlets extending beyond said top surface at a spacing less than said predetermined spacing;

wherein said one or more elongated conduits deliver said flowable material form said plenum unit to said workpiece through said conduit outlets.

2. The apparatus according to claim 1, wherein said one or more elongated conduits deliver said flowable material to said workpiece in a predetermined pattern.

3. The apparatus according to claim 1, wherein said one or more elongated conduits are removably attached to said plenum unit.

4. The apparatus according to claim 3, wherein said one or more elongated conduits are interchangeable with at least one other of said one or more elongated conduits.

5. The apparatus according to claim 3, wherein at least one of said one or more elongated conduits is replaceable by a corresponding number of elongated conduits having dimensional parameters different from dimensional parameters of said one or more elongated conduits.

6. The apparatus according to claim 1, wherein said one or more elongated conduits linearly telescope through a corresponding number of said apertures.

7. A system for controllably applying a flowable material to a workpiece, comprising:

means for delivering flowable material to a dispenser head assembly;

a dispenser head assembly comprising:

one or more elogated conduits disposed adjacent to said workpiece anf in registry with a plenum unit for transitory retention of said flowable material therein;

wherein said plenum unit comprises a dispence member having a plurality of orifices defined therethough to accommodate said one or more elogated conduits in a predetermined arrangement, said one or more elogated conduits being removably attached to said plenum unit, and a manifold member having at least one injection port defined thereon for delivering said flowable material through said plenum unit;

and a fixture means having a top surface, a bottom surface and a peripheral wall extending therebetween, said fixture means having a plurality of apertures to accommodate in aligned registration said one or more elongated conduits therethrough;

wherein said one of more elogated conduits deliver said flowable material from said plenum unit to said workpiece.

8. The system according to claim 7, further comprising pump means including a first pump for pressurizing and transferring said flowable material from a storage reservoir and a second pump for pressurizing and transferring said flowable material to said plenum unit.

9. The system according to claim 7, wherein said one or more elongated conduits deliver said flowable material to said workpiece in a predetermined pattern.

10. The system according to claim 7, wherein said one or more elongated conduits are interchangeable with at least one other of said one or more elongated conduits.

11. The system according to claim 7, wherein at least one of said one or more elongated conduits is replaceable by a corresponding number of elongated conduits having dimensional parameters different from dimensional parameters of said one or more elongated conduits.

12. The system according to claim 7, wherein said one or more elongated conduits linearly telescope through a corresponding number of said apertures.

13. A method for controllably applying a flowable material to a workpiece, the method comprising the steps of:

(i) positioning a flowable material dispenser head in registration with and adjacent to a workpiece, wherein said dispense head assembly comprises:

one or more elongated conduits in registry with a plenum unit for transitory retention of said flowable material therein; wherein said plenum unit comprises a dispense member having a plurality of orifices defined therethrough to accommodate said one or more elongated conduits in a predetermined arrangement and a manifold member having at least one injection port defined therein for delivering said flowable material through said plenum unit; and a fixture means having a top surface, a bottom surface and a peripheral wall extending therebetween, said fixture means having a plurality of apertures to accommodate in aligned registration said one or more elongated conduits therethrough; wherein said one or more elongated conduits are operable to deliver said flowable material from said plenum unit to said workpiece;

(ii) positioning said one or more elongated conduits through said plurality of apertures to define a predetermined clearance between said one or more elongated conduits and said fixture means; and (iii) operating said one or more conduits to deliver said flowable material from said plenum unit to said workpiece.

14. The method of claim 13 further comprising the step of dispensing said material in a predetermined pattern. means for delivering flowable material to a dispenser head assembly; a dispenser head assembly comprising: one or more elongated conduits disposed adjacent to said workpiece and in registry with a plenum unit for transitory retention of said flowable material therein; wherein said plenum unit comprises a dispense member having a plurality of orifices defined therethrough to accommodate said one or more elongated conduits in a predetermined arrangement, said one or more elongated conduits being removably attached to said plenum unit, and a manifold member having at least one injection port defined therein for delivering said flowable material through said plenum unit; and a fixture means having a top surface, a bottom surface and a peripheral wall extending therebetween, said fixture means having a plurality of apertures to accommodate in aligned registration said one or more elongated conduits therethrough; wherein said one or more elongated conduits deliver said flowable material from said plenum unit to said workpiece.

* * * * *

UNITED STATES PATENT AND TRADEMARK OFFICE

CERTIFICATE OF CORRECTION

PATENT NO. : 6,511,707 B1
DATED : January 28, 2003
INVENTOR(S) : MacDonald et al.

It is certified that error appears in the above-identified patent and that said Letters Patent is hereby corrected as shown below:

Column 7,
Line 33, should read -- ...each of said conduits having a conduit outlet; --.
Line 52, should read -- ...material from said plenum… --.

Column 8,
Line 10, should read -- ...workpiece and in registry… --.
Line 12, should read -- ...comprises a dispense… --.
Line 17, should read -- ...port defined therein… --.

Signed and Sealed this

Ninth Day of December, 2003

JAMES E. ROGAN
*Director of the United States Patent and Trademark Office*